US006657923B2

(12) United States Patent
Laughlin

(10) Patent No.: US 6,657,923 B2
(45) Date of Patent: Dec. 2, 2003

(54) SLOT MACHINE ALARM CLOCK APPARATUS AND METHOD

(76) Inventor: Benjamin L. Laughlin, 4130 Weller Rd., Rock Stream, NY (US) 14878

( * ) Notice: Subject to any disclaimer, the term of this patent is extended or adjusted under 35 U.S.C. 154(b) by 0 days.

(21) Appl. No.: 10/213,221

(22) Filed: Aug. 6, 2002

(65) Prior Publication Data

US 2003/0035346 A1 Feb. 20, 2003

Related U.S. Application Data

(63) Continuation-in-part of application No. 09/585,312, filed on Jun. 1, 2000, now abandoned.

(51) Int. Cl.[7] ..... G04B 47/00; G04B 23/02; G04C 21/00; A63B 71/00

(52) U.S. Cl. ..... 368/10; 368/73; 368/250; D10/6; 273/143 R

(58) Field of Search ..... 368/10, 72–74, 368/88, 243, 250, 257, 276, 278; D10/6; D21/70; 273/142 R, 143 R

(56) References Cited

U.S. PATENT DOCUMENTS 2,708,337 A * 5/1955 Leach ..... 365/272
3,357,703 A 12/1967 Hurley
3,835,640 A * 9/1974 Hughes, Jr.
5,311,488 A * 5/1994 Trantham ..... 368/250
5,402,396 A * 3/1995 Jones, Jr. ..... 368/250
D361,516 S * 8/1995 Peersmann
5,452,270 A * 9/1995 Ikeda et al.
5,469,346 A * 11/1995 Haut et al.
5,519,672 A 5/1996 Zwolinski
5,560,603 A 10/1996 Seelig et al.
5,584,764 A * 12/1996 Inoue et al.
D380,687 S * 7/1997 Hsu
5,683,296 A 11/1997 Rasmussen
6,009,048 A 12/1999 Raesz
6,089,978 A 7/2000 Adams
6,206,781 B1 3/2001 Sunaga et al.

* cited by examiner

*Primary Examiner*—Vit Miska
(74) *Attorney, Agent, or Firm*—Wall Marjama & Bilinski LLP

(57) ABSTRACT

An alarm clock is shaped as a miniature slot machine. The alarm is set by pulling the handle forward, just as one activates a real slot machine. When the alarm goes off, the wheels spin and stop one at a time on a jackpot combination, accompanied by the sound one would hear from a real slot machine. A light on top of the machine flashes, accompanied by sound that mimics the sounds of a jackpot on a real slot machine. The snooze alarm is set by pushing the handle to the rear.

15 Claims, 8 Drawing Sheets

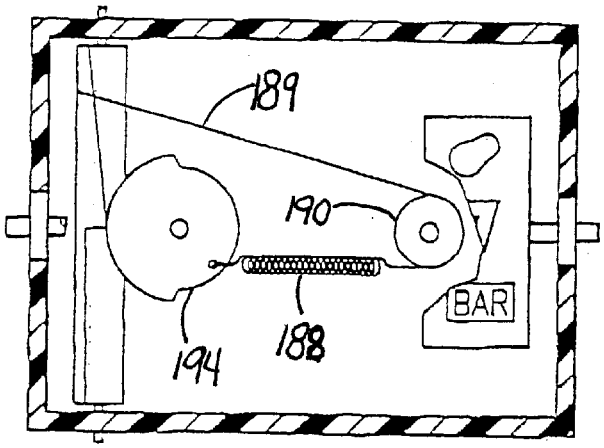
FIG.11
FIG.12
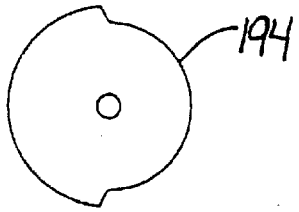
FIG.13
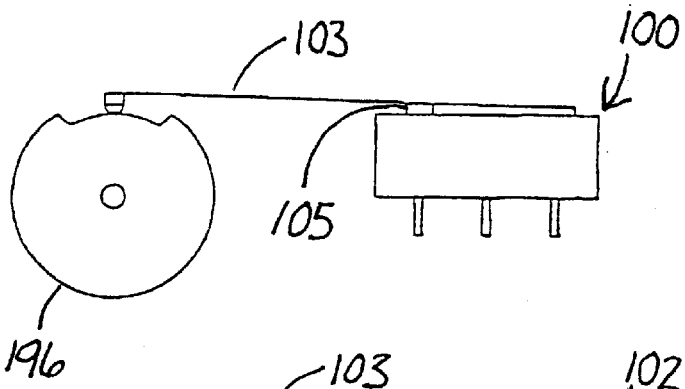
FIG.14
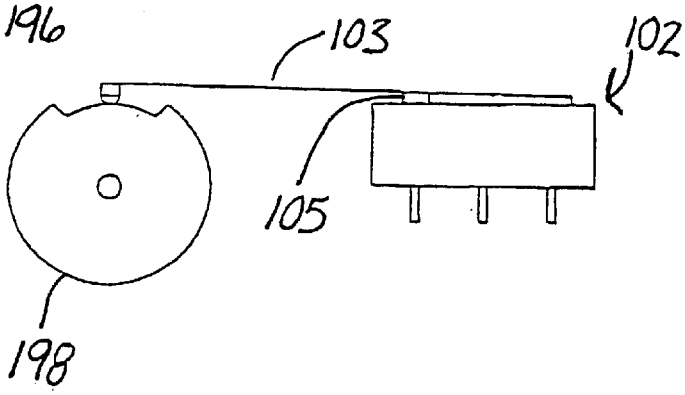

SLOT MACHINE ALARM CLOCK APPARATUS AND METHOD

CROSS REFERENCE TO RELATED APPLICATION

This is a continuation-in-part application of U.S. Ser. No. 09/585,312, filed Jun. 1, 2000 now abandoned, the entirety of which is incorporated herein by reference.

FIELD OF THE INVENTION

This invention relates to the field of decorative alarm clocks, and in particular to an alarm clock in the shape of a slot machine.

BACKGROUND OF THE INVENTION

Decorative alarm clocks come in many shapes and sizes. U.S. Pat. No. 3,357,703 discloses a combined clock and chance device which displays generally square outlines to represent the faces of two dice. A user can "roll" the dice and observe the results on the clock face. In the absence of "rolling", the total number of illuminated dots is equal to the hour of the day, while an associated portion of the display unit provides the minutes.

U.S. Pat. No. 5,519,672 discloses an alarm clock that simulates a fishing reel mounted on a fishing rod. The side plates are provided with various elements necessary for the operation of the alarm clock with some of those elements simulating the elements of a reel. For example, the volume is controlled by the reel handle and the reel clicker on/off control operates the alarm on/off switch. The overall result is an alarm clock that looks, feels, and sounds like a fishing reel.

Design Pat. No. 361,516 discloses an ornamental design for a clock that looks like a slot machine, but no details are disclosed of how it works.

SUMMARY OF THE INVENTION

Briefly stated, an alarm clock is shaped as a miniature slot machine. The alarm is set by pulling the handle forward, just as one activates a real slot machine. When the alarm goes off, the wheels spin and stop one at a time on a jackpot combination, accompanied by the sound one would hear from a real slot machine. A light on top of the machine flashes, accompanied by sound that mimics the sounds of a jackpot on a real slot machine. The snooze alarm is set by pushing the handle to the rear.

According to an embodiment of the invention, an alarm clock includes an outer shell; an inner mechanism affixed inside the outer shell; a handle penetrating the outer shell and connected to the inner mechanism; the inner mechanism including display means for displaying a plurality of rotating wheels wherein each wheel includes a plurality of indicia thereon such that only one of the plurality of indicia on each wheel is visible to an operator through a first opening in the outer shell; the inner mechanism further including a clock module which includes a clock display visible to the operator through a second opening in the outer shell; and wherein the outer shell, the display means, and the handle combine to present an appearance substantially identical to a slot machine.

According to an embodiment of the invention, a method for operating an alarm clock to mimic an operation of a slot machine includes the steps of (a) providing an outer shell and handle having an appearance of the slot machine; (b) setting an alarm by pulling the handle forward a first time; (c) deactivating the alarm by pulling the handle forward a second time; (d) displaying, when the alarm activates, a plurality of rotating wheels wherein each wheel includes a plurality of indicia thereon such that only one of the plurality of indicia on each wheel is visible to an operator through a first opening in the outer shell; and (e) stopping the display of rotating wheels such that visible indicia on the wheels represent a jackpot combination.

BRIEF DESCRIPTION OF THE DRAWINGS

FIG. 11 is a view of the hinge arm/camming mechanism of FIG. 10 taken along line 5—5.

FIG. 12 is a top view of the cam illustrated in FIG. 11.

FIG. 13 illustrates a top view of a first cam-switch shown in FIG. 10.

FIG. 14 illustrates a top view of a second cam-switch shown in FIG. 10.

DETAILED DESCRIPTION OF THE INVENTION

Figure 1:
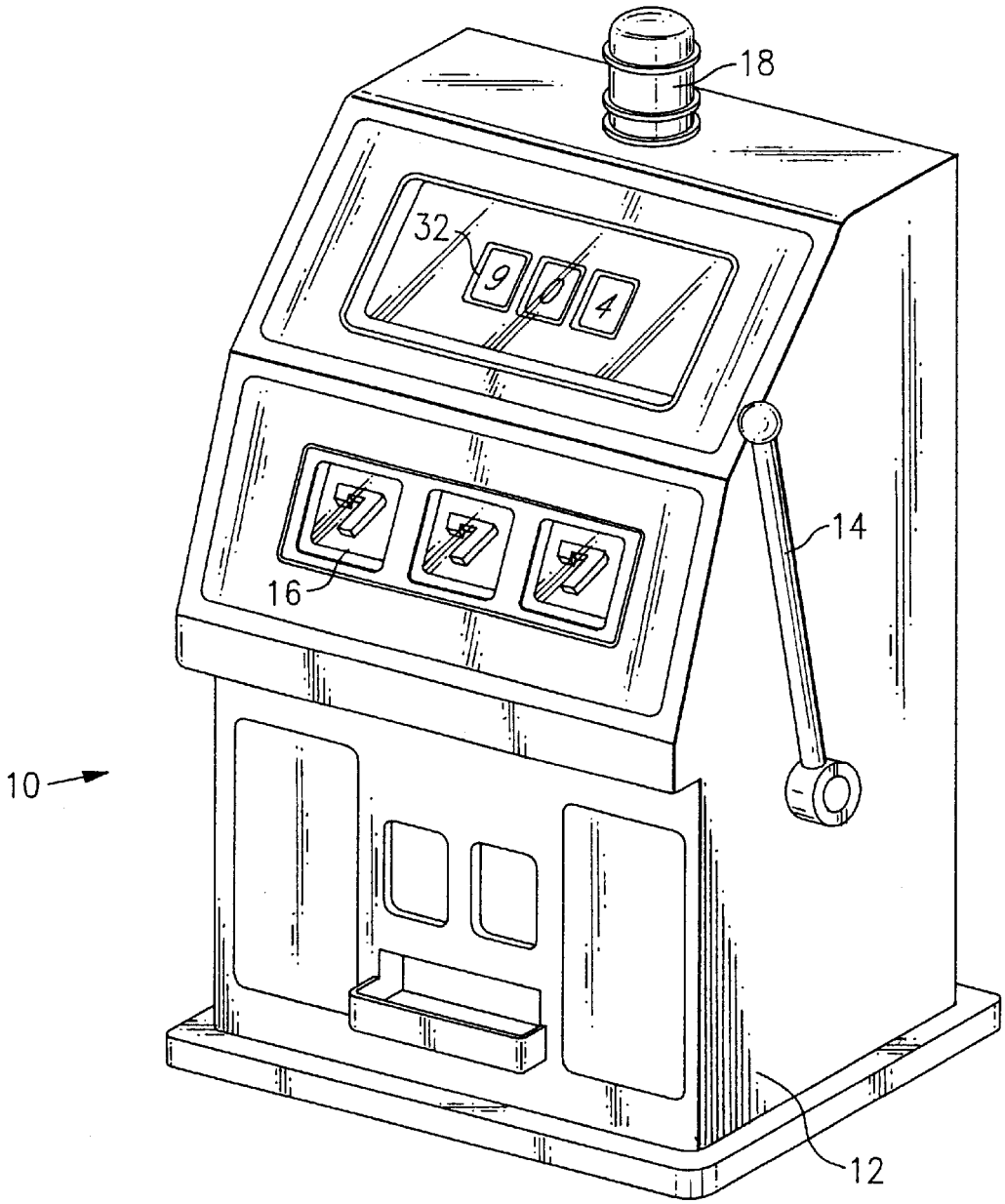
FIG. 1 shows a front elevation view of an alarm clock according to an embodiment of the present invention.
Figure 2:
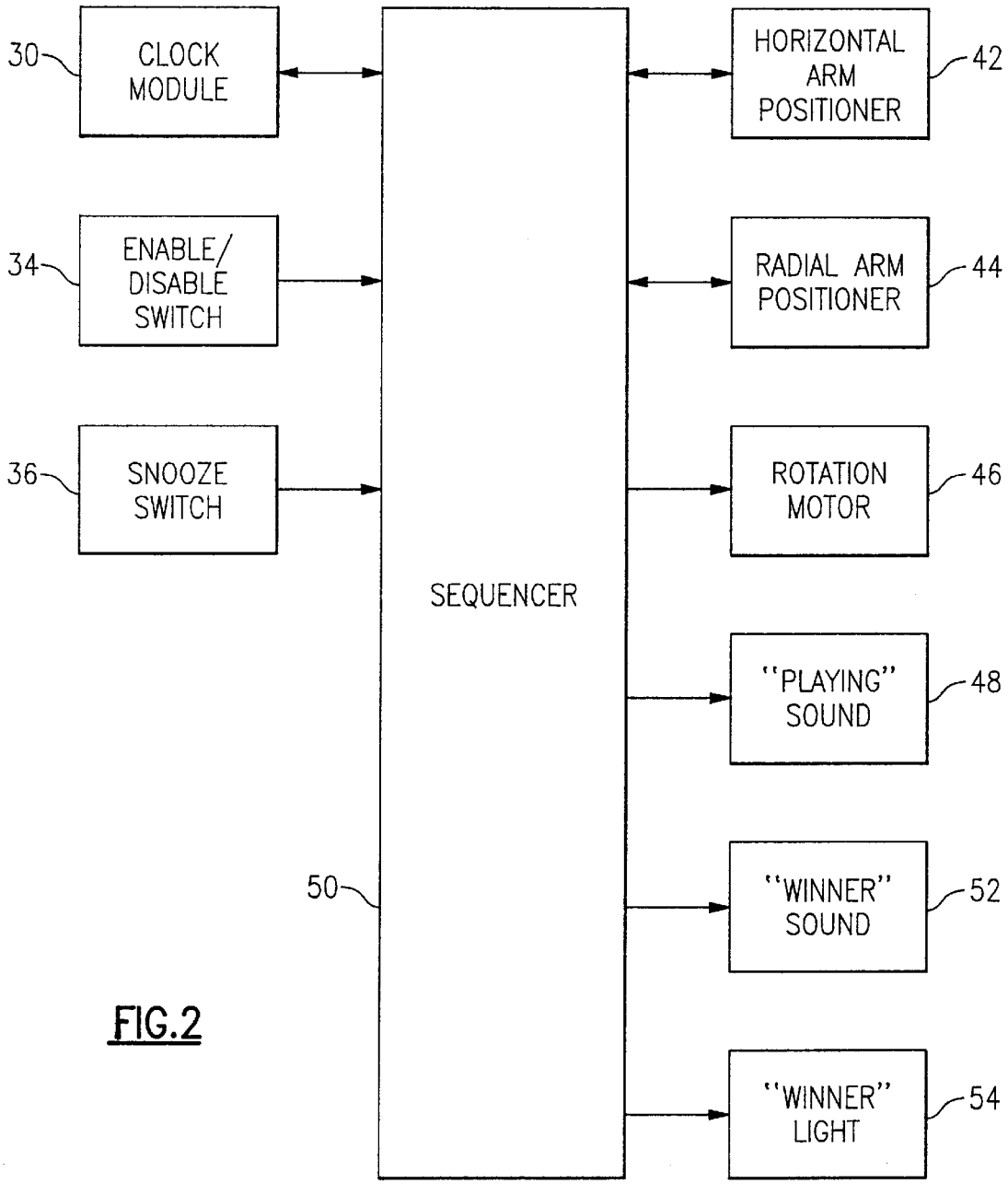
FIG. 2 shows a block diagram of the operational components of an alarm clock of an embodiment of the present invention.

Referring to FIGS. 1–12, a slot machine alarm clock 10 of the present invention contains circuitry as shown in the block diagram of FIG. 2 inside a body 12. A sequencer 50 coordinates the operation of the entire device. Sequencer 50 is preferably programmed from a PLD (programmable logic device) or optionally from a personal computer. Arrows between sequencer 50 and other boxes show the direction of control signals. A clock module 30 is a fairly generic alarm clock subsystem, including a numerical display 32; push-buttons (not shown) to set the hour and minute for both the current time and the time that the alarm should go off; and a lighted indicator (not shown) to show whether the alarm function is enabled or disabled.

Sequencer 50 sends a signal to clock module 30 when the alarm function is enabled or disabled, and when the snooze function is selected, delaying the alarm for some predetermine period of time. Clock module 30 sends an alarm signal to sequencer 50 when the alarm time arrives.

An enable/disable switch 34 is used to arm or disarm the alarm. In this implementation, enable/ disable switch 34 is activated by pulling a handle 14 on a side of body 12. Pulling handle 14 forward, as one would do when playing a slot machine in a casino, sets the alarm by activating enable/disable switch 34. Pulling handle 14 again disables the alarm. Typically, one would enable the alarm by pulling handle 14 when going to bed. When the alarm activates in the morning, one would pull handle 14 again to turn the alarm off. One could also disable the alarm by pulling handle 14 before the alarm is activated.

A snooze switch 36 is used to invoke the snooze feature of clock module 30. Snooze switch 36 is activated by pushing handle 14 backwards. When the alarm goes off, pushing back on handle 14 temporarily deactivates the alarm actions and enables them to restart after a short interval, typically about ten minutes.

A "playing" sound mimics the sounds that a real slot machine makes when the handle is pulled and the wheels are spinning. A "winner" sound is a sound effect that mimics the sounds that a real slot machine makes when the wheels have stopped spinning, and a winning combination of symbols is showing. A "winner" light 18 flashes when the wheels stop spinning and a winning combination of symbols is showing on a jackpot display 16. These features are generated by a playing sound module 48, a winner sound module 52, and a winner light module 54. The use of these modules is described later. Optional lights under each wheel makes the spinning numbers visible while the wheels are spinning.

Figure 3:
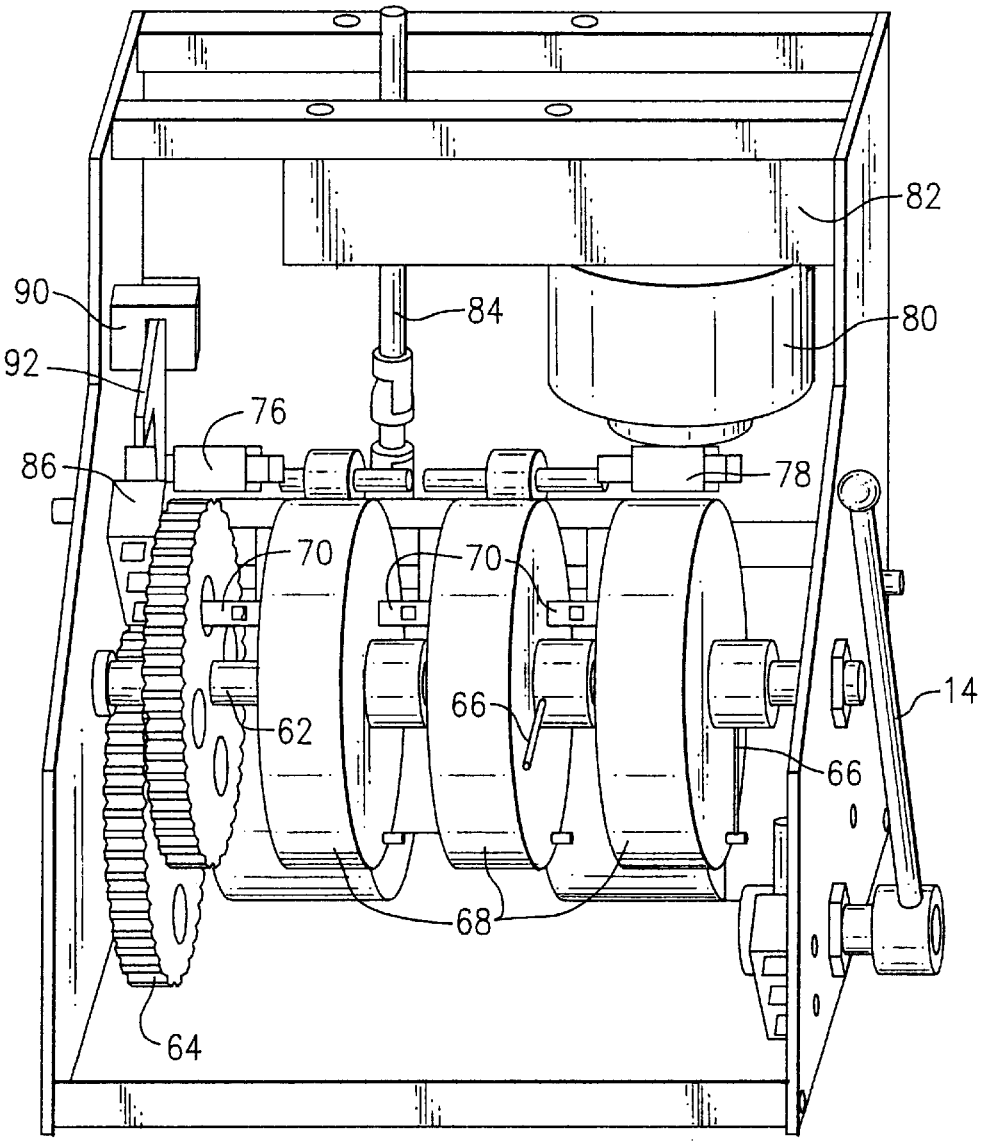
FIG. 3 shows a front perspective view of the inner mechanism of the alarm clock of an embodiment of the present invention.
Figure 4:
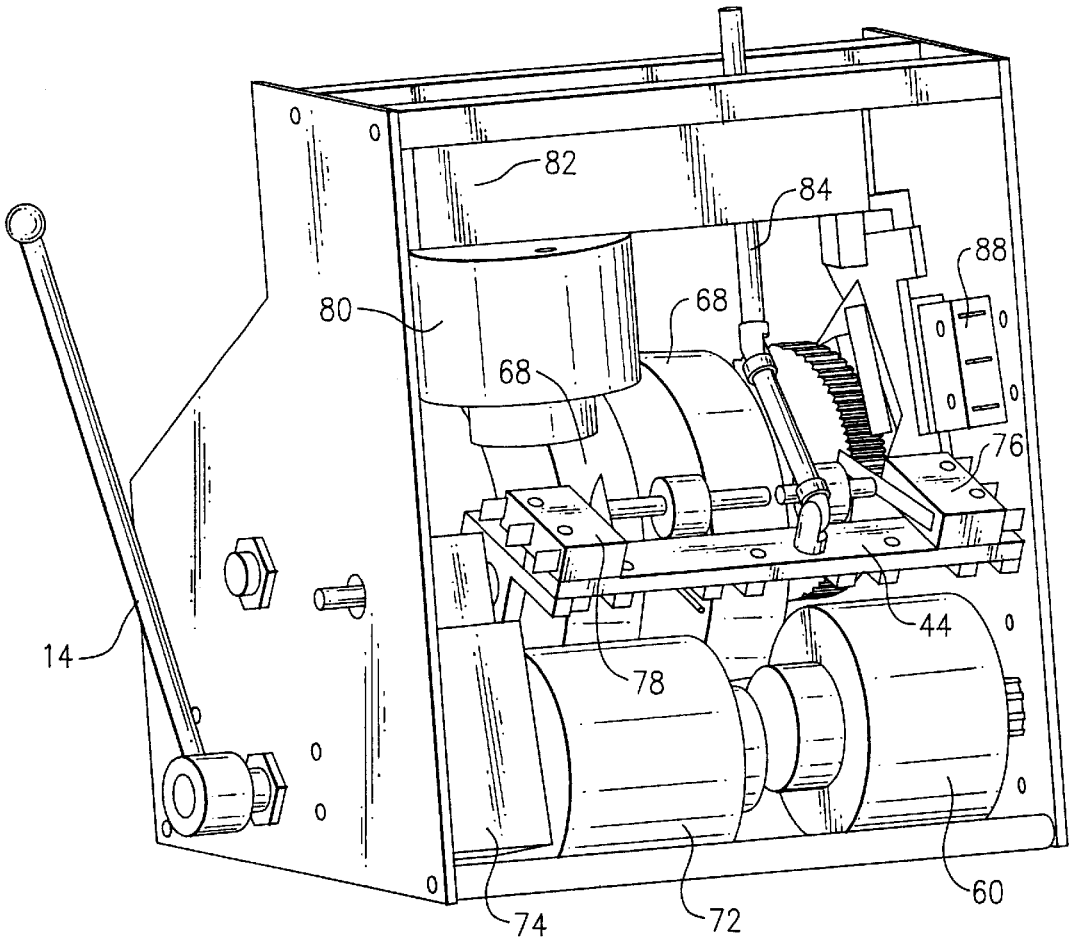
FIG. 4 shows a rear perspective view of the inner mechanism of the alarm clock of an embodiment of the present invention.

Referring to FIGS. 3–4, a rotation motor 60 causes a wheel shaft 62 to rotate via a rotation gear drive 64. Spring clutches 66 engage wheels 68 and make wheels 68 rotate. When a stopping arm 70 is engaged with a wheel 68, it overrides spring clutch 66 and prevents further rotation of wheel 66. Each wheel 68 has its own stopping arm 70. Stepper motors, one for each wheel, are optionally used instead of rotation motor 60.

A horizontal arm positioner 42 is a bi-directional motor with limit switches on each end. Horizontal arm positioner 42 uses a motor 72 and gears inside a gearbox 74 to move stopping arms 70 either towards or away from wheels 68. An away limit switch 76 is activated to indicate when arms 70 are moved fully away from wheels 68. An engaged limit switch 78 is activated to indicate when arms 70 are fully engaged with wheels 68. The limit switches 76, 78 serve two purposes. First, they let sequencer 50 know when the arms 70 have traveled as far as they should normally go. Second, they disconnect power from motor 72 to prevent damage if sequencer 50 is defective.

A radial arm positioner 44, which is controlled by sequencer 50, uses a motor 80 and a gear drive inside a gearbox 82 to move stopping arms 70 either towards the center of wheels 68 or towards the outer diameter of wheels 68. A linkage 84 connects the gear drive inside gearbox 82 to positioner 44. An inner limit switch 86 is activated when arms 70 are closest to the shaft 62 on which wheels 68 rotate. An outer limit switch 88 is activated when arms 70 are near the outer diameter of the wheels 68. The limit switches 86, 88 serve the same purposes as those on horizontal arm positioner 42. That is, they let sequencer 50 know when the arms 70 have traveled as far as they should normally go, and they disconnect power from motor 72 to prevent damage if sequencer 50 is defective.

Radial arm positioner 44 also includes an optical sensor 90 and a position plate 92 with a plurality of holes in it. Optical sensor 90 includes a light source, a light detector, and a gap between the two. Position plate 92 passes through the gap. As arms 70 are moving radially, optical sensor 90 is activated when a hole in position plate 92 allows the beam of light to pass from the light source to the light detector. The holes are preferably located so that light passes through them when arms 70 are aligned with one of the "winning" positions.

Sequencer 50 coordinates the operation of the device in its various modes of operation. The potential sequences are:

(1) enable the alarm function, (2) start the alarm actions, (3) disable the alarm function when the alarm is activated, (4) disable the alarm function when the alarm is not activated, (5) enable the snooze function when the alarm is activated, and (6) enable the snooze function when the alarm is not activated.

The sequence of activities that sequencer 50 performs is now described for each of the modes of operation.

(1) Enable the Alarm Function

This sequence starts with the alarm function being disabled and the user first pulling forward and then releasing handle 14. Sequencer 50 detects that handle 14 has been pulled forward by sensing that enable/disable switch 34 is closed. Sequencer 50 detects that handle 14 is released by waiting until it senses that enable/disable switch 34 is open. A counter in sequencer 50 is continually running, with its value changing 60 times per second. At the instant that handle 14 is released, the value of this counter is remembered. This value is preferably used as the winning number for the next spinning of the wheels. Since there are only a few possible winning positions of the wheels, preferably between 3 and 10, and the counter is changing so fast, the resulting winning number is essentially random. No one number is favored over another.

At the same time, sequencer 50 energizes horizontal arm positioner motor 72 to move arms 70 in the direction away from wheels 68. Sequencer 50 detects that arms 70 are fully away from wheels 68 by waiting until it senses that away limit switch 76 is open. Horizontal arm positioner motor 72 is then de-energized. Next, sequencer 50 energizes radial arm positioner motor 80 to move arms 70 towards the center of wheels 68. Sequencer 50 detects that arms 70 are near the center of wheels 68 by waiting until it senses that inner limit switch 86 is open. The direction of radial arm positioner motor 80 is now changed so as to move arms 70 away from the center of wheels 68. As position plate 92 travels through the gap in optical sensor 90, sequencer 50 counts how many times the beam of light is allowed to pass through the holes in position plate 92. When the count is equal to the previously remembered winning number, radial arm positioner motor 80 is de-energized. Finally, a signal is sent to clock module 30 notifying it that the alarm has been enabled. An "alarm enabled" indicator light in clock module 30 lights to show that the alarm is enabled.

(2) Start the Alarm Actions

This sequence starts with the alarm function enabled and clock module 30 sending a signal that the alarm time has arrived. Sequencer 50 detects that the alarm time has arrived by sensing the alarm signal from clock module 30. Rotation motor 60 is energized and wheels 68 start spinning. Playing sound module 48 is energized and a sound that a real slot machine might make is heard. After a few seconds, sequencer 50 energizes horizontal arm positioner motor 42 to move arms 70 in the direction towards wheels 68. First arm 70 stops first wheel 68 at the appropriate position. A moment later, second arm 70 stops second wheel 68. After another moment, third arm 70 stops third wheel 68. Sequencer 50 detects that arms 70 are fully engaged with wheels 68 by waiting until it senses that engaged limit switch 78 is open. The mechanical alignment of the device is preferably adjusted so that engaged limit switch 78 is activated almost immediately after the third arm 70 stops the third wheel.

At this time, horizontal arm positioner motor 72, rotation motor 46, and playing sound module 48 are de-energized while winner sound module 52 and winner light module 54 are energized. A winning combination is preferably shown on wheels 68. The sound plays and the light flashes either until the alarm function is disabled or the clock module 30 disables the alarm signal. This is typically about an hour and depends on the clock module 30 used.

(3) Disable the Alarm Function When Alarm Is Activated

This sequence starts with the alarm function enabled, the alarm actions in progress, and the user first pulling forward and then releasing the handle 14. Sequencer 50 detects that handle 14 has been pulled forward by sensing that enable/disable switch 34 is closed. Sequencer 50 detects that handle 14 is released by waiting until it senses that enable/disable switch 34 is open. If the alarm function is disabled before the alarm actions have completed, including several seconds of playing the winner sound and flashing the winner light, then sequencer 50 waits before disabling the alarm function. If the sound and lights have been active for a few seconds, then the disabling is immediate. Sequencer 50 de-energizes winner sound module 52 and winner light module 54. Sequencer 50 also sends a signal to clock module 30 notifying it that the alarm has been disabled. Clock module 30 turns off the alarm enabled indicator light.

(4) Disable the Alarm Function When Alarm Is Not Activated

This sequence starts with the alarm function enabled, no alarm time signal yet from the clock module, and the user first pulling forward and then releasing handle 14. Sequencer 50 detects that handle 14 has been pulled forward by sensing that enable/disable switch 34 is closed. Sequencer detects that handle 14 is released by waiting until it senses that enable/disable switch 34 is open. No alarm actions will occur. Sequencer 50 sends a signal to clock module 30 notifying it that the alarm has been disabled. Clock module 30 turns off the alarm enabled indicator light.

(5) Enable the Snooze Function When Alarm Is Activated

This sequence starts with the alarm function enabled, the alarm actions in progress, and the user first pushing back and then releasing handle 14. When snooze switch 36 is activated, sequencer 50 immediately stops the current alarm actions and prepares for a new alarm signal. Sequencer 50 detects that handle 50 has been pushed back by sensing that snooze switch 34 is closed. Sequencer 50 detects that handle 14 is released by waiting until it senses that snooze switch 34 is open. Sequencer 50 de-energizes whichever of the following outputs are energized: horizontal arm positioner 42, radial arm positioner 44, rotation motor 46, playing sound module 48, winner sound module 52, and winner light module 54. Sequencer 50 then follows the actions described above in Step 1 (Enable the Alarm Function), with the exception of the last action. Since clock module 30 already knows that the alarm is enabled, a signal is sent to clock module 30 notifying it that snooze switch 36 has been activated and that it should turn off the alarm signal and re-assert it after the snooze period expires.

(6) Enable the Snooze Function When Alarm Is Not Activated

This sequence starts with the alarm function disabled and the user first pushing back and then releasing handle 14. This action would normally not do anything necessary for the operation of alarm clock 19, but optionally makes the slot machine mechanism run through a demonstration cycle.

Figure 5:
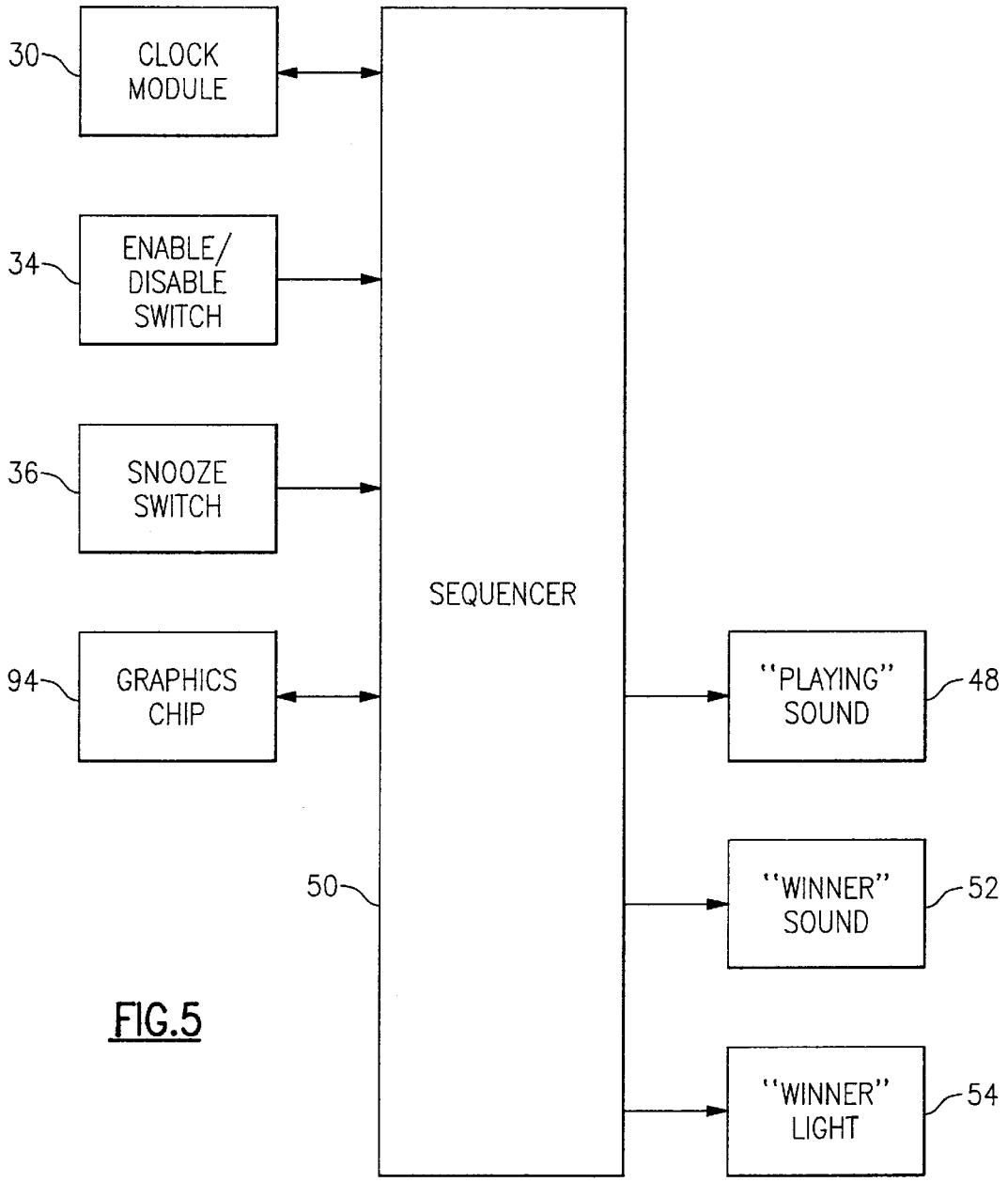
FIG. 5 shows a block diagram of the operational components of an alarm clock of an embodiment of the present invention.
Figure 6:
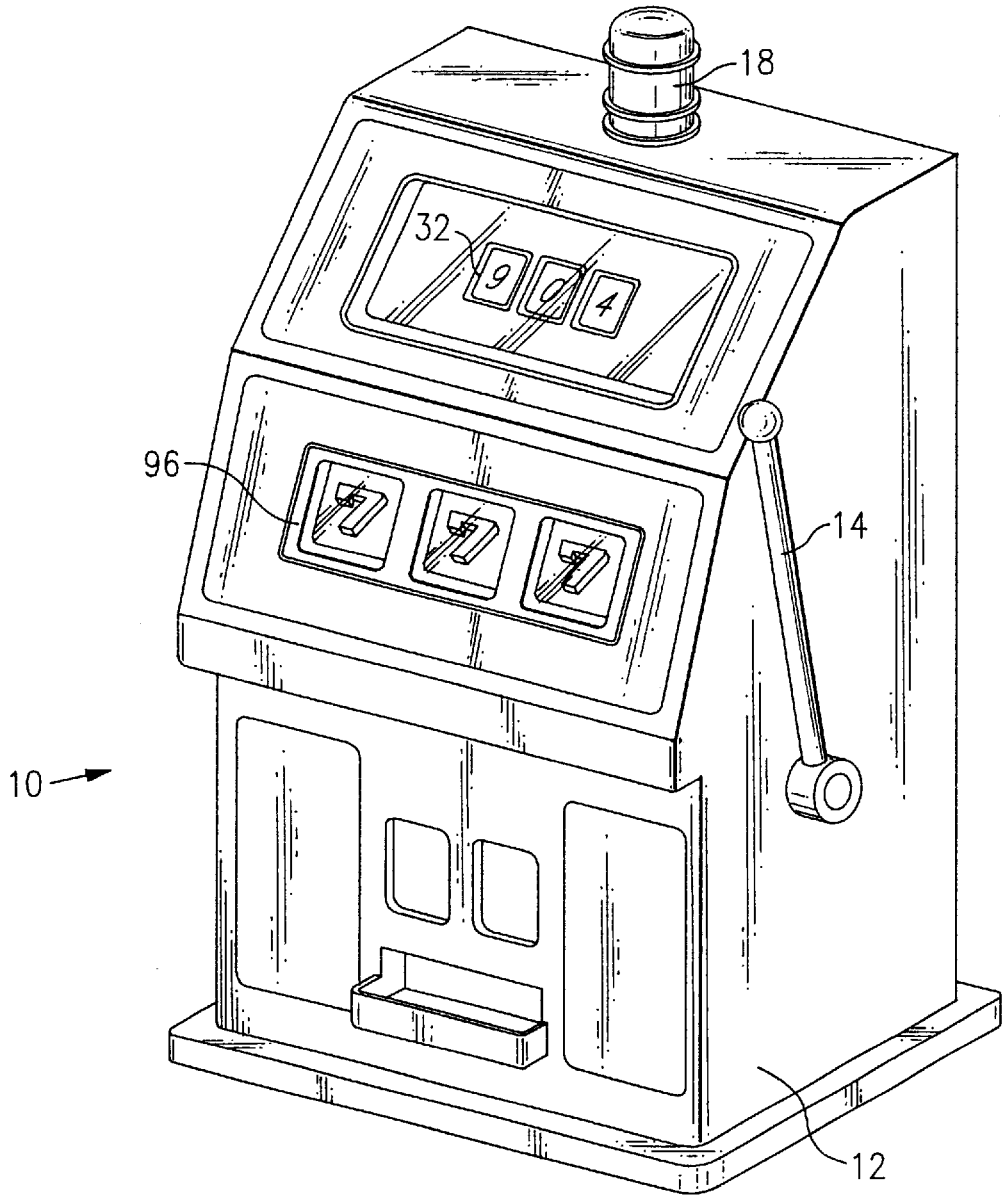
FIG. 6 shows a front elevation view of an alarm clock according to an embodiment of the present invention.
Figure 7:
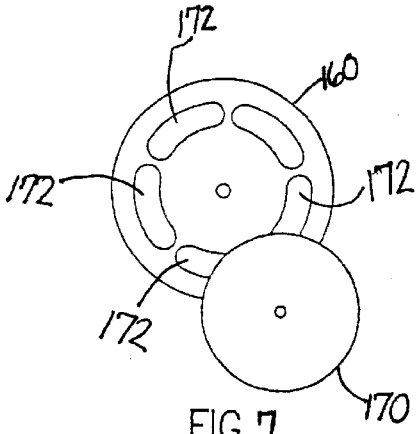
FIG. 7 is a side view of the drive wheel according to an embodiment of the invention.

Referring to FIGS. 5–6, an alternative embodiment uses a visual display 96 instead of jackpot display 16 of the previous embodiment. Visual display 96 is any graphics display such as an LED display, LCD display, plasma display, or even a CRT display if the alarm clock is large enough. A graphics chip 94 replaces horizontal arm positioner 42, radial arm positioner 44, and rotation motor 46 to provide a visual image of the jackpot wheels on display 96. The remainder of the functioning is as described with respect to the previous embodiment.

A further alternative embodiment which uses a camming/hinge arm arrangement to stop the plurality of wheels such that the visible indicia represent a jackpot combination is illustrated in FIGS. 7–14. In this embodiment the horizontal arm positioner 42 and radial arm positioner 44 are replaced in the block diagram of FIG. 2 with the camming/hinge arm arrangement.

Figure 8:
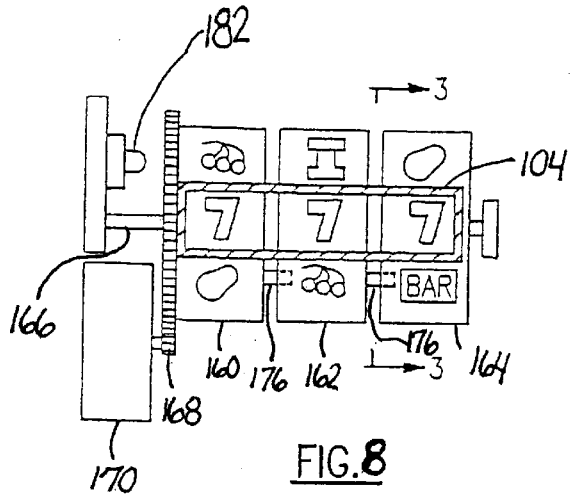
FIG. 8 is a partial side sectional view of wheel stopping mechanism according to an embodiment of the invention.

As illustrated in FIG. 8, wheels 162 and 164 have been indexed with drive wheel 160 through pins 176 to insure that the indicia or images seen through viewing window 104 will represent a jackpot combination. Wheel 160 has an indexing pin 176 fixed to its right side. This pin enters slot 174 shown in wheel 162. On start up, this pin will rotate through the path of the slot settling at some "out-of register" position. The effect is of wheels starting in order 160, 162 and 164 and stopping in the same order. All wheel graphics are identical; 10 images, 36 degree centers, cover plate openings block visibility of all but one line of graphics. Wheel 160 is motor driven. Wheels 162 and 164 are free to lag the driven wheel, scrambling the order, giving the illusion of randomness.

Figure 9:
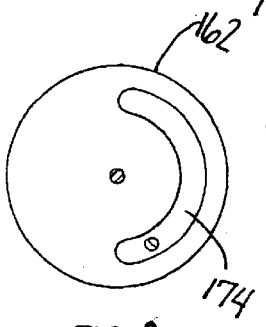
FIG. 9 is a side view of one of the nondrive wheels taken along line 3—3 of FIG. 8.
Figure 10:
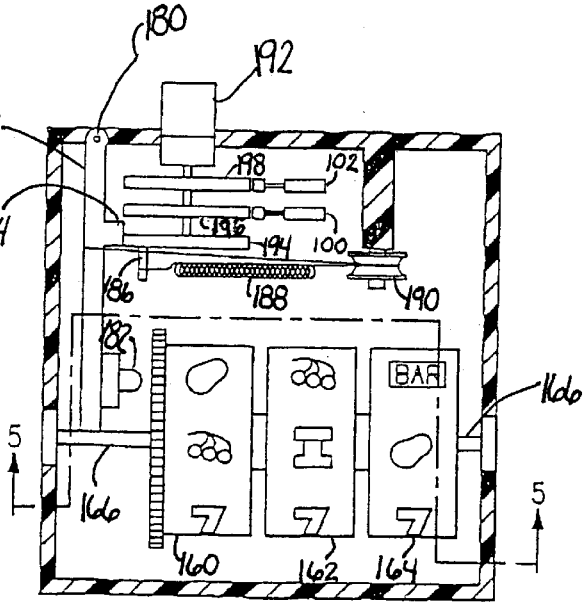
FIG. 10 is a top view of the device illustrated in FIG. 8.

As illustrated more clearly in FIGS. 7–10, wheels 160, 162 and 164 contain the appropriate indicia to form a winning jackpot combination are positioned on drive shaft 166, with drive wheel 160 containing a gearing mechanism 168 driven by motor 170. Drive wheel 160 contains a series of five evenly spaced radial slots 172 which are designed to accommodate pin 182 contained on hinge arm 178. Wheels 162 and 164 each contain a single radial slot 174 having an arc of 180° as illustrated in FIG. 9. Slot 174 is designed to receive a pin 176 which is designed to ride in and is fixed within said slot.

Arm 178 is hinged at 180 and contains a projection 184 designed to contact cam 194, and at its free end contains a pin 182 which is designed to fit into one of radial slots 172 of drive wheel 160. Cams 196 and 198 are connected to micro switches 100 and 102, respectively, with all three cams being driven by motor 192. A spring 188 is connected to pin 186 on cam 194 and is connected to a wire 189 at its opposite end which winds around pulley 190. The other end of wire 189 is connected to arm 178 and through the camming action of cam 194 provides motion to arm 178 to allow pin 182 to move into and out of locking (stopping) arrangement in one of slots 172 contained in the face of drive wheel 160.

In operation, an alarm signal from the clock module is converted to a 100 millisecond pulse which overrides cam switch 196 starting motor 192 (FIGS. 10–14). As the pulse ends, the motor will continue to run through the cam switch until one cycle is complete. This system also powers wheel drive motor 170.

Cam 194 contains a vertical pin 186 which is connected to spring 188 which at its opposite end is connected to a wire 189 which is wound around pulley 190 and attached to arm 178. Cam 194 lifts hinge arm 178 from engagement with drive wheel 160 and continues revolving, tensioning spring 188, and at end of its revolution, releases hinge arm to re-engage and stop drive wheel 160.

Wheels 162 and 164 revolve freely on shaft 166. Wheel 160 is driven by gear motor 170 and indexed by hinge arm 178 and pin 182 designed to engage one of radial slots 172. Wheel 162 will begin to move through pin 176 on wheel 160 when drive wheel 160 has moved 180 degrees. Wheel 164 will begin to move through pin 176 on wheel 162 when wheel 162 has moved 180 degrees. This is to scramble the images seen through viewing window 104.

When the timing cycle is complete, cam 194 releases hinge arm 178 and pin 182 is driven into one of the five slots 172, and at the same time cam switch 100 will turn off motor 192 and wheels 162 and 164 will stop sequentially to present a jackpot combination. At the same time cam switch 102 initiates alarm sounds and lights. Cam switches 100 and 102 each have an activator arm 103 which controls a switch button 105 (FIGS. 13 and 14).

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. An alarm clock, comprising:

an outer shell;

an inner mechanism affixed inside said outer shell;

a handle penetrating said outer shell and connected to said inner mechanism;

said inner mechanism including a plurality of discrete rotatable wheels wherein each wheel includes a plurality of indicia thereon such that only one of said plurality of indicia on each wheel is visible to an operator through a first opening in said outer shell;

with said inner mechanism further including means for stopping said plurality of wheels such that said visible indicia represent a jackpot combination; where said means for stopping said plurality of wheels includes a horizontal positioner and a radial positioner;

display means for displaying said plurality of wheels;

said inner mechanism further including a clock module which includes a clock display visible to said operator through a second opening in said outer shell with said clock including means for setting an alarm and means for deactivating said alarm; and wherein said outer shell, said display means, and said handle combine to present an appearance substantially identical to a slot machine.

2. An alarm clock according to claim 1, wherein said means for setting said alarm and said means for deactivating said alarm include a sequencer and an enable/disable switch connected to said handle such that pulling said handle forward a first time activates said alarm and pulling said handle forward a second time deactivates said alarm.

3. An alarm clock according to claim 1, wherein said inner mechanism further includes:

means for producing a playing sound;

means for producing a winner sound; and means for producing a winner light.

4. An alarm clock according to claim 1, wherein said inner mechanism further includes means for activating a snooze function of said alarm.

5. An alarm clock according to claim 1, wherein said means for rotating said plurality of wheels includes a rotation motor.

6. An alarm clock according to claim 1, wherein said inner mechanism further includes at least one light under said plurality of wheels whereby said plurality of wheels are illuminated.

7. An alarm clock according to claim 1, wherein said means for activating said snooze function includes said sequencer and a snooze switch connected to said handle such that pushing said handle backward activates said snooze switch.

8. An alarm clock, comprising:

an outer shell;

an inner mechanism affixed inside said outer shell;

a handle penetrating said outer shell and connected to said inner mechanism;

said inner mechanism including a plurality of discrete rotatable wheels wherein each wheel includes a plurality of indicia thereon such that only one of said plurality of indicia on each wheel is visible to an operator through a first opening in said outer shell;

with said inner mechanism further including means for stopping said plurality of wheels such that said visible indicia represent a jackpot combination; where one of said wheels is a drive wheel which controls the rotation and stopping of said other wheels and where said drive wheel is stopped by a hinge arm/camming means through a stop pin contained on said hinge arm which is moved by said camming means into stopping engagement in one of a plurality of radial slots contained on one side of said drive wheel;

display means for displaying said plurality of wheels;

said inner mechanism further including a clock module which includes a clock display visible to said operator through a second opening in said outer shell with said clock including means for setting an alarm and means for deactivating said alarm; and wherein said outer shell, said display means, and said handle combine to present an appearance substantially identical to a slot machine.

9. An alarm clock according to claim 8, wherein said means for setting said alarm and said means for deactivating said alarm include a sequencer and an enable/disable switch connected to said handle such that pulling said handle forward a first time activates said alarm and pulling said handle forward a second time deactivates said alarm.

10. An alarm clock according to claim 8, wherein said inner mechanism further includes:

means for producing a playing sound;

means for producing a winner sound; and means for producing a winner light.

11. An alarm clock according to claim 8, wherein said inner mechanism further includes means for activating a snooze function of said alarm.

12. An alarm clock according to claim 8, wherein said means for rotating said plurality of wheels includes a rotation motor.

13. An alarm clock according to claim 8, wherein said inner mechanism further includes at least one light under said plurality of wheels whereby said plurality of wheels are illuminated.

14. An alarm clock according to claim 8, wherein said means for activating said snooze function includes said sequencer and a snooze switch connected to said handle such that pushing said handle backward activates said snooze switch.

15. An alarm clock, comprising:

an outer shell;

an inner mechanism affixed inside said outer shell;

a handle penetrating said outer shell and connected to said inner mechanism;

said inner mechanism including a plurality of discrete rotatable wheels wherein each wheel includes a plurality of indicia thereon such that only one of said plurality of indicia on each wheel is visible to an operator through a first opening in said outer shell;

with said inner mechanism further including means for stopping said plurality of wheels such that said visible indicia represent a jackpot combination; where one of said wheels is a drive wheel which controls the rotation and stopping of said other wheels and where said drive wheel is stopped by a hinge arm/camming means through a stop pin contained on said hinge arm which is moved by said camming means into stopping engagement in one of a plurality of radial slots contained on one side of said drive wheel and wherein the rotation and stopping of said other wheels is controlled by a pin on an adjacent wheel which rides in a radial slot contained on the face of the wheel being controlled;

display means for displaying said plurality of wheels;

said inner mechanism further including a clock module which includes a clock display visible to said operator through a second opening in said outer shell with said clock including means for setting an alarm and means for deactivating said alarm; and wherein said outer shell, said display means, and said handle combine to present an appearance substantially identical to a slot machine.

* * * * *